US007385507B2

(12) United States Patent
Simpson et al.

(10) Patent No.: US 7,385,507 B2
(45) Date of Patent: Jun. 10, 2008

(54) SECURITY CASE

(76) Inventors: Anthony T. Simpson, 968 Northlake Blvd., Lake Park, FL (US) 33403; Randall L. Koelz, 18988 SE. Bryant Dr., Tequesta, FL (US) 33469

( * ) Notice: Subject to any disclaimer, the term of this patent is extended or adjusted under 35 U.S.C. 154(b) by 287 days.

(21) Appl. No.: 11/015,400

(22) Filed: Dec. 17, 2004

(65) Prior Publication Data

US 2006/0145847 A1 Jul. 6, 2006

(51) Int. Cl.
*G08B 13/14* (2006.01)
*E05G 1/00* (2006.01)

(52) U.S. Cl. ..... 340/568.1; 340/571; 109/29; 109/31; 109/32; 109/38; 109/42; 109/43; 109/44

(58) Field of Classification Search ..... None
See application file for complete search history.

(56) References Cited

U.S. PATENT DOCUMENTS 3,653,342 A * 4/1972 Chilton ..... 109/31
4,461,222 A * 7/1984 Brunner et al. ..... 109/29
4,762,231 A * 8/1988 Kiselewski ..... 206/522
4,799,435 A * 1/1989 Boutroy ..... 109/25
4,843,371 A 6/1989 Kuei et al.
5,199,361 A * 4/1993 Robinson ..... 109/51
5,627,519 A * 5/1997 Hatchimonji ..... 340/568.7
5,927,313 A * 7/1999 Hart ..... 137/15.01
6,135,253 A 10/2000 Weissman et al.
6,283,182 B1 9/2001 Fedeli
6,568,336 B2 * 5/2003 Van Lint ..... 109/29
6,644,475 B2 11/2003 Wilson et al.
2003/0011466 A1 * 1/2003 Samuel et al. ..... 340/5.73
2007/0089467 A1 * 4/2007 Ace-Kirker ..... 70/63

FOREIGN PATENT DOCUMENTS

JP 407009787 * 1/1995

* cited by examiner

*Primary Examiner*—Julie Lieu
(74) *Attorney, Agent, or Firm*—McHale & Slavin, P.A.

(57) ABSTRACT

The present invention is directed towards a container for transporting of valuables in a first compartment; particularly towards a container having a second compartment containing an alarm system. The alarm system includes an air bladder, i.e. airbag, for instantaneous and rapid deployment when triggered by a remote activator or other devices present on the container. After being triggered the air bladder inflates to a volume much greater than the second compartment and the container, such that the thief cannot easily transport the container into a car or through a doorway, or at the very least without being noticed.

24 Claims, 7 Drawing Sheets

SECURITY CASE

FIELD OF THE INVENTION

The present invention is directed towards the field of anti-theft devices and in particular to device and method for use thereof in deterring the unauthorized use and/or transport of containers by use of an inflatable air bag making the container impractical to carry without being noticed.

BACKGROUND OF THE INVENTION

Numerous systems and devices have been developed for the protection of valuables inside of or in the proximity of a building, including fortified vaults and enhanced surveillance equipment. However, little protection is provided to persons transporting jewelry, money or important documents between secure locations, when such valuables are at their most vulnerable. The majority of robberies perpetrated upon delivery persons are low-tech and nonviolent. For example, a thief will generally wait until a jewelry distributor is in their vehicle on route to or from a jewelry store. Often, the robber will utilize some means to coerce the distributor from the road and confiscate their merchandise. Since the merchandise, while immensely valuable, is usually small and compact, a representative can easily be robbed of thousands, or possibly millions, of dollars of merchandise in a fairly unobtrusive manner. This can result in them becoming uninsurable and can affect their future livelihood.

What is needed is a security case that will prevent the unobtrusive confiscation of valuables by creating such a scene and/or obstacle that a thief could not possibly take possession of the case without drawing attention.

DESCRIPTION OF THE PRIOR ART

U.S. Pat. No. 6,283,182 to Fedeli is directed towards an ejection device for use in expelling objects from the inside of a bag in the event of a bag-snatching. The patent teaches a compressed gas canister coupled to an expandable sack that is inflated to cause the contents of the bag to be expelled. The purpose of this invention is to spread the contents of the bag onto the ground making it difficult for a thief to collect. This means of deterring thieves is not desirable in the transport of some valuables for example, jewels or money, as some of the valuables might become lost or stolen after they are expelled onto the ground.

U.S. Pat. No. 6,135,253 to Weissman et al is directed toward a suitcase having a compressive liner capable of inflation. This invention is directed to packing all items within the container to reduce package size.

U.S. Pat. No. 6,644,475 to Wilson, II et al. is directed towards a multi-purpose bag that includes an inflatable member such that the bag can be used to store items and double as a seat cushion. While both of these references teach inflatable means inside a container, they fail to teach or suggest the use of the inflatable means as an anti-theft device.

U.S. Pat. No. 4,843,371 to Kuei et al, herein incorporated by reference in its entirety, teach a burglar alarm system for a briefcase which will generate high voltage on the surface of the briefcase, emit an alarm sound, produce flashes of light and colored smoke to arouse attention of pedestrians and finally automatically destroying the articles therein after a predetermined time so as to prevent the briefcase from being stolen. This system of deterring thieves may not be advantageous since the destruction of the property contained therein is irreversible. This is especially disastrous if the user deploys the alarm system inadvertently. The present invention provides an alarm and deterrent system that does not potentially destroy the property contained therein should the user mistakenly deploy the alarm or if the alarm system malfunctions.

What has heretofore been lacking in the art is a functional container for transporting and carrying valuables that will call attention to a thief and substantially reduce the ability of thieves to escape with the valuables contained therein.

SUMMARY OF THE INVENTION

The present invention makes use of a multipurpose container and means for protecting against theft or any unauthorized use of the container. The container comprises at least two compartments, a first compartment for transport of valuables and a second hidden compartment containing an expandable air-bladder which is inflatable by an integral inflation source upon activation, such that the air-bladder expands rapidly to a volume much greater than that of the internal volume of the second compartment and the container itself. The air bladder, e.g. an airbag, is expanded to such a large size as to prohibit the thief from easily placing the expanded airbag into a vehicle, traversing through a doorway, or the like. At the very least, the deployment of the airbag will create such a commotion that anyone in the vicinity will notice the thief for possible identification purposes.

It is therefore an objective of the instant invention to provide a multipurpose container for carrying valuables wherein a monitoring system in the container is capable of activating an alarm system comprising an integrally disposed inflatable air bladder which is swiftly deploying via a compressed fluid from a secret compartment to substantially enlarge the size of the container.

Accordingly, it is an objective of the instant invention to teach a portable remote activation means in communication with a container monitoring system, wherein the activation means can be triggered by a code entered into the keypad of a telephone or pager, panic button on a key fob, panic button on said container, or other form of activation known in the art.

Similarly, it is an objective of the instant invention to teach a multipurpose container wherein the container monitoring system can be disabled by the activator means, such as a predetermined code on a key fob or predetermined code entered into the keypad of a telephone.

It is a further objective of the instant invention to teach a container monitoring system comprising a GPS (Global Positioning System) receiver for receiving radio signals from a GPS satellite to determine the spatial position of the container once out of possession of owner.

It is another objective of the instant invention to teach a container monitoring system comprising at least one sensor for detecting penetration of the material surrounding the container, such that any penetration deploys the alarm system of the instant invention.

It is an additional objective of the instant invention to teach a container monitoring system that can activate the alarm system when there is a forced entry of the container by overt manipulation of the locking means, or multiple incorrect combination entries.

It is yet another objective of the instant invention to provide a container monitoring system comprising a single or multiple receiver(s) whereby the predetermined distance between the receiver(s) in the activator means and the monitor is checked such that if the predetermined distance is exceeded the alarm system is enabled.

Yet a further objective of the instant invention is to teach an air bladder that inflates to such a pressure that the air bladder is difficult to puncture and moves away from any applied puncturing means.

Moreover, it is an additional object of the present invention to teach an air bladder made from a self-sealing material such that the air bladder material will not deflate, or deflate at a slow rate, when pierced by sharp object.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objectives and features thereof.

DETAILED DESCRIPTION OF THE INVENTION

Figure 1:
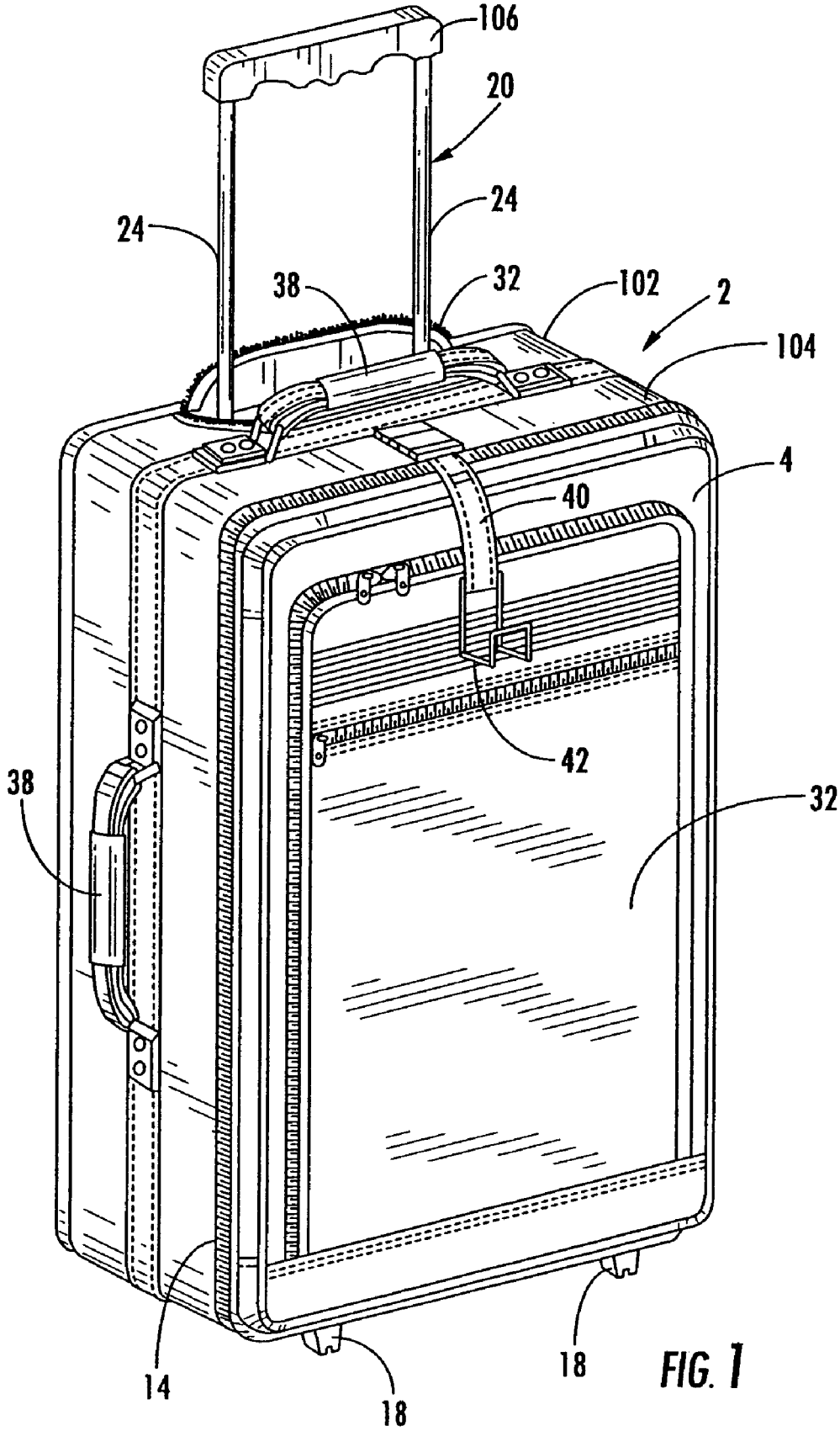
FIG. 1 is a top perspective view of the multi-purpose container according to a one representative embodiment of the invention in a closed condition such that the second hidden compartment is not visible.
Figure 2:
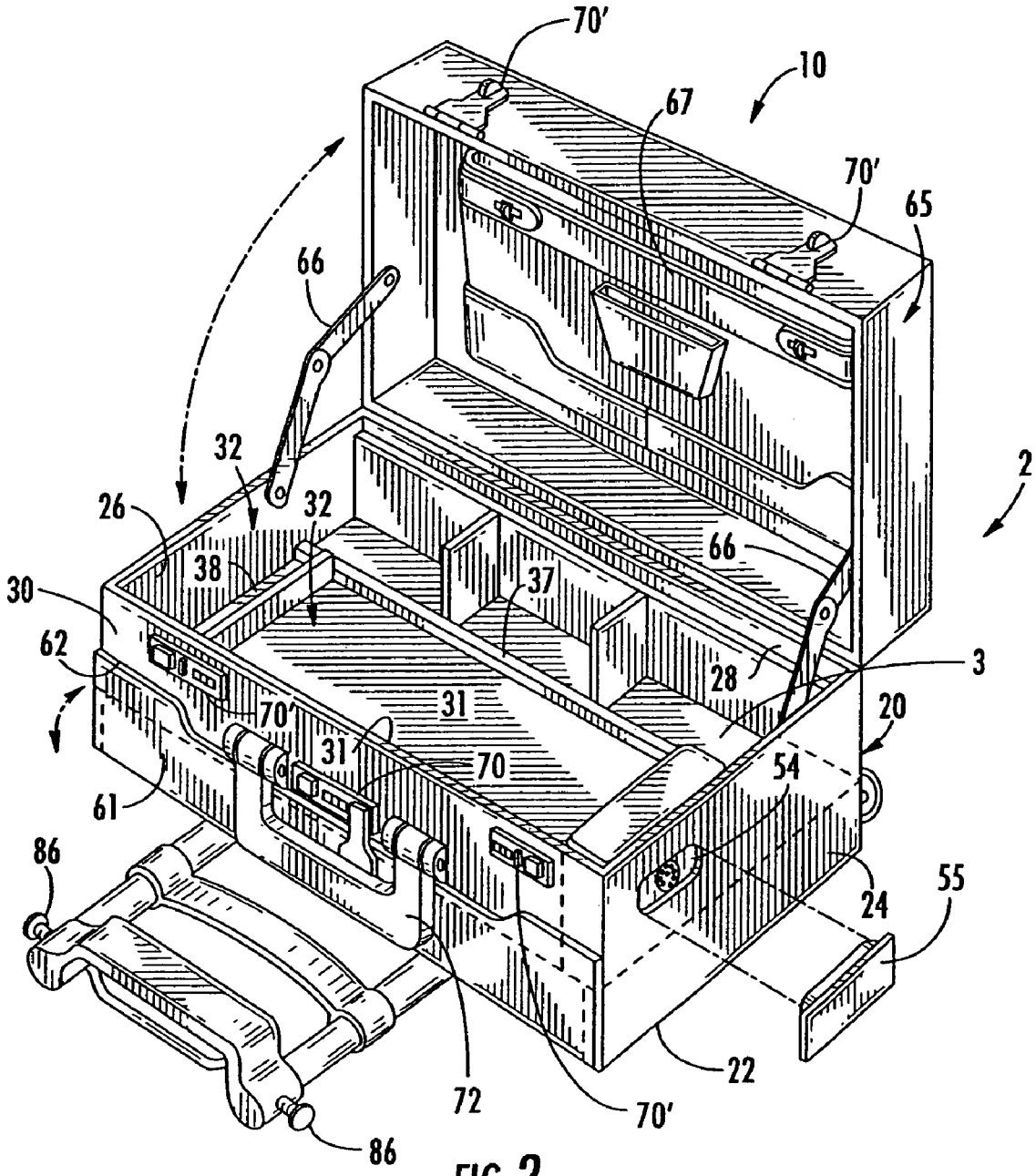
FIG. 2. illustrates an elevated perspective of the multi-purpose container in FIG. 1 in an open state wherein the second compartment is not readily visible.

The instant invention is directed towards a security container 2 to both deter and thwart theft. The proposed, albeit non-limiting embodiment shown in FIG. 1, illustrates a security container 2 of the instant invention, which looks like an ordinary suitcase trolley used to transport articles. The security container 2 can include various forms known in the art, including but not limited to a purse, briefcase, suitcase, trolleys, backpack, etc. In FIG. 2 the container 2 is in an open state illustrating one embodiment of a first compartment 3 having an adequate volume to transport items, preferably valuable items. Additionally, the means for opening 4 the container 2 can include those known in the art, such as a zipper, latch, hinge or the like.

Figure 3:
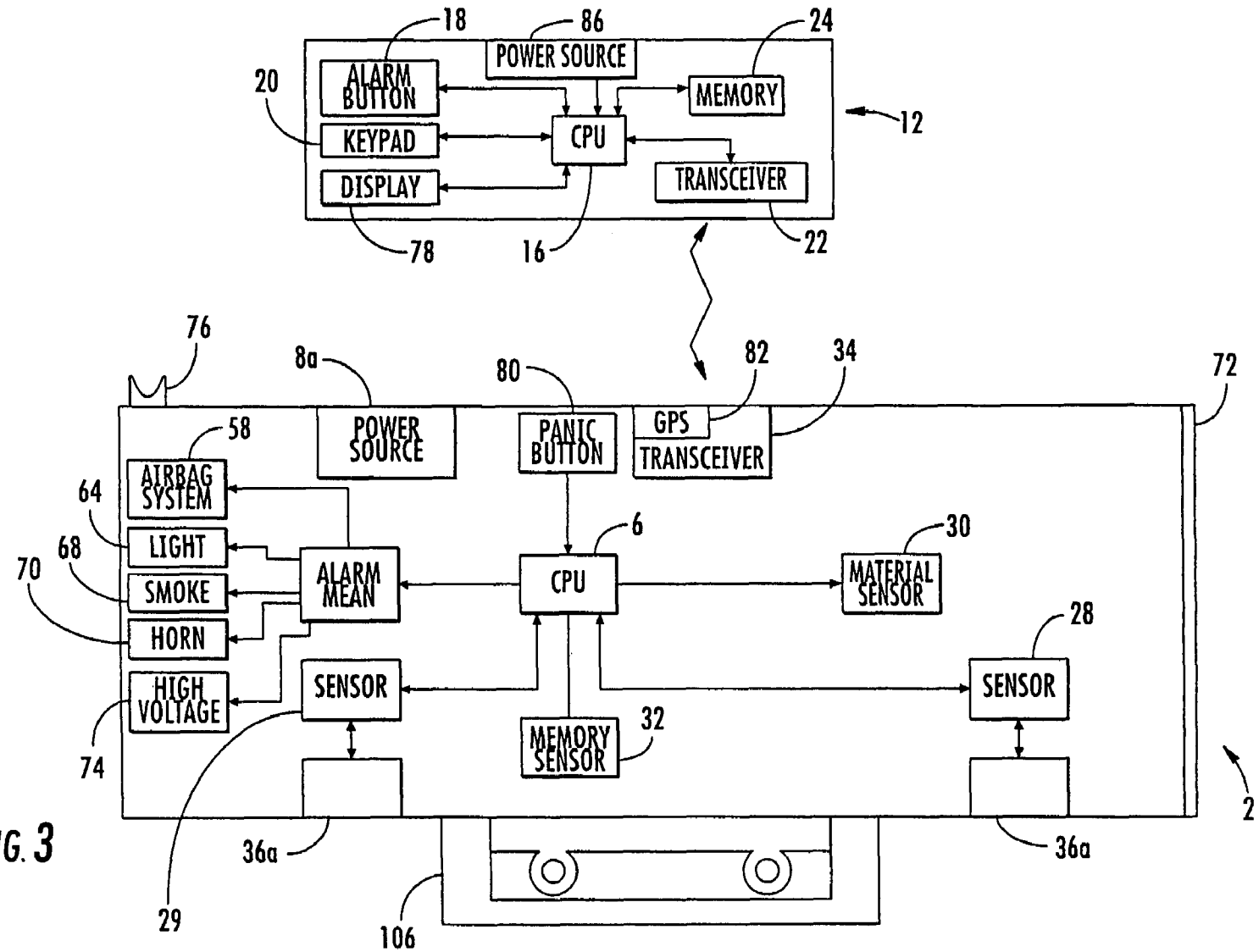
FIG. 3. illustrates a block diagram of the internal components of the portable remote activator system and a first embodiment of the container monitoring system.

The security system includes a container monitoring system 10 inside the security case 2 (FIG. 3). The container monitoring system 10 comprises an alarm system 46 that can comprise one or more various alarm means e.g. air bladder alarm 58, flasher 64, smoke circuit 68, sound alarm (i.e. horn) 70 or high voltage generator 74 (FIG. 4) inside a second compartment 14, which is not obvious when the container is closed. Similarly, the second compartment 14 may be constructed such that is virtually undetectable when the container 2 is opened, as seen in FIG. 2, such that if a thief has been studying the container's owner before the robbery, he will not be alerted to the presence of alarm means inside. The sizes of the alarm system components are chosen according to the container size and design.

Additionally, the system can include a remote activator 12 to trigger the container monitoring system 10 from a remote distance, see FIG. 3. The remote activator 12 is portable and can be used by the container's owner to activate the container monitoring system 10 when needed. This remote activator 12 may be disguised as, or functionally integrated, into any shape or form. For example, as disclosed in U.S. Pat. No. 5,995,007, herein incorporated by reference to Borjo et al, disclosed in a functional wristwatch with a proximity monitoring system disposed inside. Additionally, the remote activator 12 components can be integrated into a pager, key fob or cell phone. This prevents the perpetrator from recognizing the remote activator 12 and stealing it along with the container 2 should the thief become aware of the proximity deployment condition of the alarm system of the present invention, discussed in detail below. Preferably, the remote activator 12 contains a display 78 means for displaying communications sent to the transceiver 22 of the remote activator 12 from the container monitoring system or GPS satellites, discussed in greater detail below.

Figure 4:
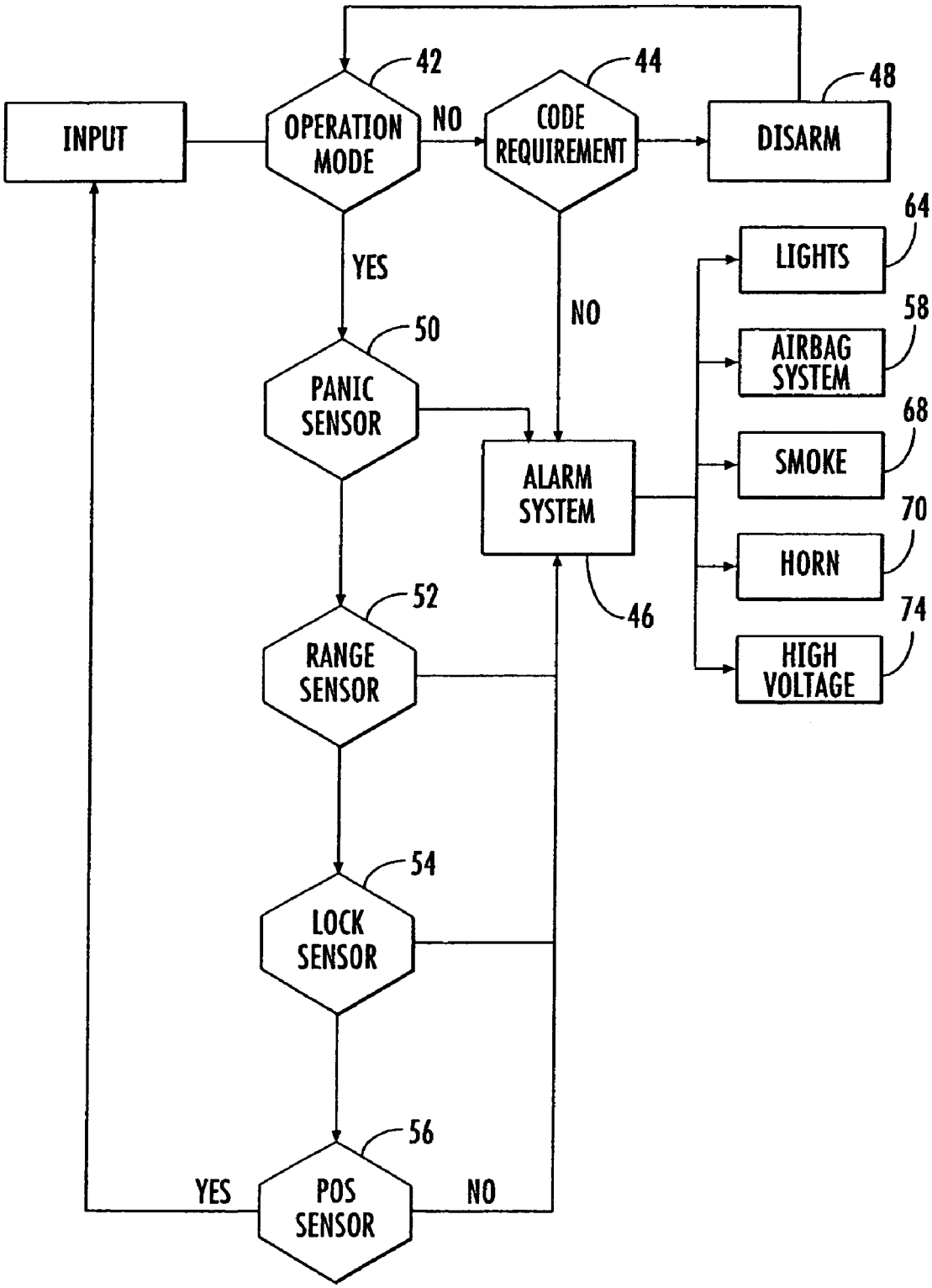
FIG. 4. illustrates a flow diagram of the internal components of the container monitoring system seen in FIG. 3.

In a first embodiment shown in FIGS. 3 and 4, the container monitoring system 10 comprises a central processor unit (CPU) or control means 6 for controlling the operation of the monitoring system. The container monitoring system 10 is supplied by power source 8*a*. Wherein portions of the container monitoring system 10, are preferably located within a protective housing (not shown) inside the second hidden compartment 14 of the container 2. This prevents damage to electrical components should the container 2 get knocked around, especially during deployment of an air bladder alarm system 58, discussed in reference to FIG. 4 below. Preferably all the components of the monitoring system 10, except the alarm system 46 components (i.e. air bladder alarm 58, flasher 64, smoke circuit 68, sound means 70 and high voltage generator 74) are contained within the housing (not shown), as certain components of the alarm system 46 should have unencumbered access to the exterior of the container 2.

One of ordinary skill will appreciate that a rechargeable battery, replaceable battery or other means of recharging known in the art may be used as the power sources 8*a*, 8*b* to power the container monitoring system 10 and the remote activator 12. It should be appreciated that the portable remote activator 12 may include CPU 16 containing appropriate program instructions or control logic stored in a memory means 24 as shown in FIG. 3.

In the first embodiment of FIG. 3, the container monitoring system 10 is electrically linked to at least one electromechanical means 36*a* for locking the container 2. The electromechanical locking means 36*a* is shown electrically connected to two sensors 28 that are in electrical communication with the CPU 6 such that the CPU 6 initiates the alarm system 46 in response to a sensed theft event. For example, one or both sensors 28 can be adapted to sense a pulling or prying force exerted upon the electromechanical locking means 36*a* that is greater than a predetermined pulling force stored in a memory means 32. The memory means 32 can include ROM/RAM type memory, database or other type of memory known in the art. When the sensor 28 produces a signal indicative of excess force, the signal is set to the CPU 6 and to the alarm means 46.

Alternatively, one or both of the sensors 28 may be adapted to detect when a foreign object not comprising the correct pin-and-tumbler design of the key is inserted into the electromechanical locking means 36*a*, such as the case when a thief attempts to pick the electromechanical locking 36*a*. Additionally, the electromechanical locking means 36*a* can include a sensor 28 that will energize the CPU 6 and alarm means 46 after a predetermined amount of time after an item has been inserted into the electromechanical locking 36*a* and has not been opened. This will restrict authorized opening and closing of the electromechanical locking lock 36*a* to a predetermined amount of time, as disclosed in U.S. Pat. No. 4,114,412 to Braatz, herein incorporated by reference.

Moreover, in another embodiment the electromechanical locking means 36*a* comprises a combination lock, such as the electronic combination switch lock 6100 series (not shown) commercially available from the Sargent & Greenleaf in Nicholasville, Ky., wherein the sensors 28 are in electrical communication with the CPU 6 and memory means 32, such that the predetermined code, or combination, stored in memory means 32 is compared with that entered into the combination lock. Preferably, the CPU 6 will allow the user a predetermined amount of tries at the correct combination before the alarm system 26 of the present invention is deployed.

Additionally, the container monitoring system 10 in the first embodiment can include a network of minute sensors (as disclosed in U.S. Pat. No. 5,831,531 to Tuttle, herein incorporated by reference) in electrical communication with the container CPU 6. These sensors can be imbedded in the material of the container and in electrical communication to create a complete circuit such that any penetration through the container material 32 will short the circuit and cause the CPU 6 to activate the alarm system 46.

Figure 8:
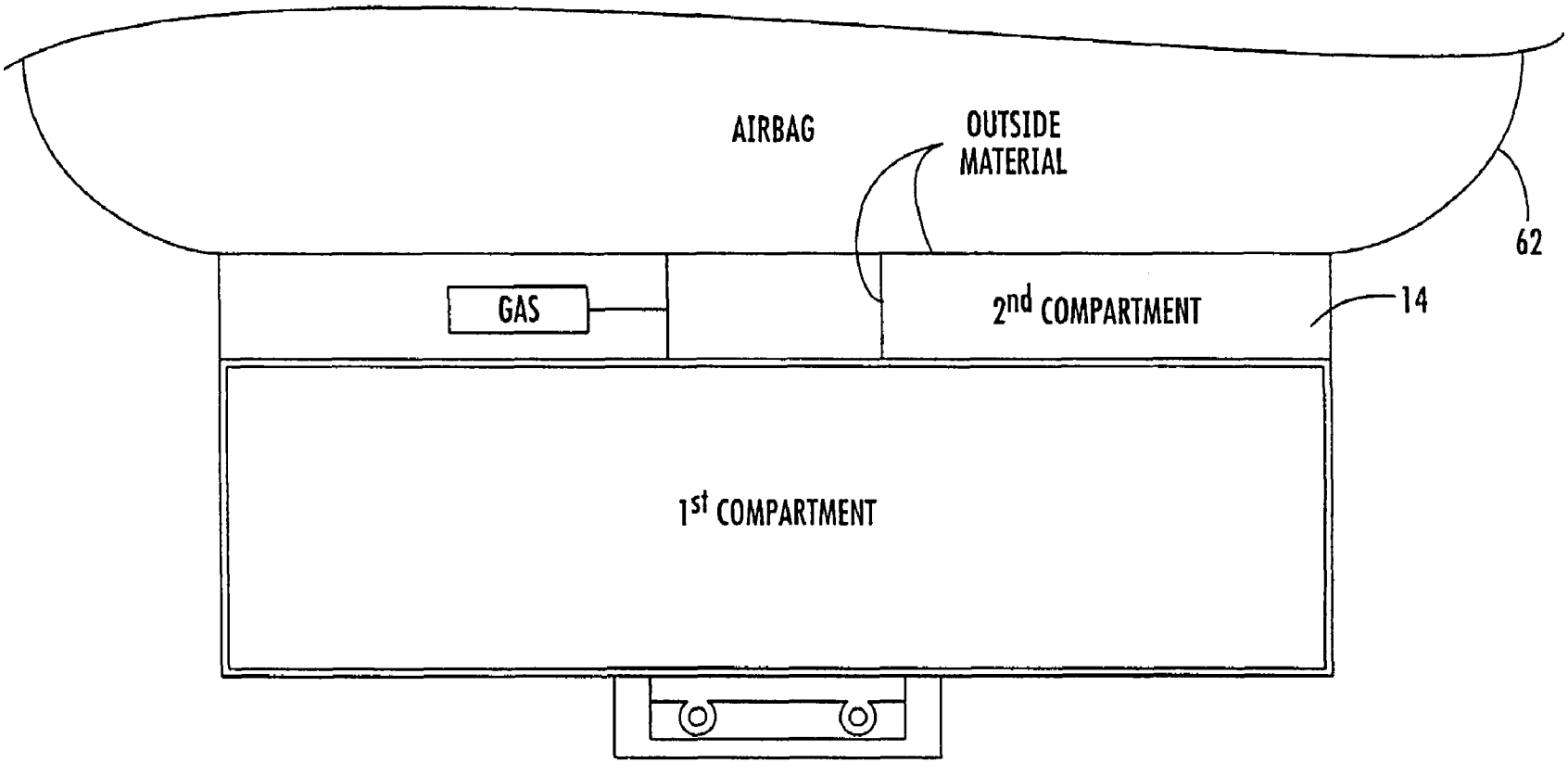
FIG. 8. illustrates a cross-section of the multi-purpose container in FIG. 1 such that the hidden second compartment containing wherein the airbag component of the present invention is visible in an activated state.

Alternatively, the sensor network could comprise a single sensor 30, as illustrated in FIG. 3, in electrical communication with a conductive material known in the art, encompassing the outside of the container wherein penetration will initiate the alarm system 46. Preferably, at least part of the container material 72 proximate the stowed air bladder alarm means 58 should be made of such a material, for example vinyl, able to permit the air bladder 62 to easily burst from the second compartment 14 to the outside of the container as shown in FIG. 8.

The container monitoring system 10 includes a transceiver 34 for remote communication with the transceiver 22 located in remote activator means 12 (FIG. 3). In a preferred embodiment the communication link 40 is wireless, however the communication link can be hardwired, radio, infrared (IR) or any other means of remote communication known in the art. The transceiver 34 of the present invention preferably includes a GPS receiver component 82 that receives radio signals from a GPS satellite system. These radio signals are used to determine the spatial position of the container 2 once out of possession of owner. The spatial position of the container 2 is then transmitted to the transceiver 22 in the remote activator 12 and displayed on display means 78. Although the GPS receiver 82 in FIG. 3 is integrated with the transceiver 34 it would be obvious to the skilled artisan to provide a separate GPS receiver 82 that can be located any where on the container 2. The memory means 32 in the container or memory means 24 in the remote activator 12 can be used to store data indicative of the current spatial position of the GPS receiver 82. These spatial coordinates can then be communicated to the remote activator 12 and ultimately to the police to locate the thief and/or the container 2.

As shown in FIG. 3, the container monitoring system may include at least one panic button 80, located anywhere on the container, in electrical communication with the CPU 6. This allows the owner to deploy the alarm system 46 of the present invention if the remote activator 12 is not readily available. In a preferred embodiment, the button 80 is hidden from plain site on the container 2 (i.e. handle 106), such that the thief is not alerted to its presence. Similarly, the remote activator 12 can comprise a panic button 18 similar to that used in car alarm system, in communication with the transceiver 22 to provide instant deployment of the air bladder 62 if the owner is attacked.

Operation of the container monitoring system 10 of FIG. 3 is best understood by making reference to the monitoring sequence shown in flow chart of FIG. 4. The operation of the container monitoring system 10 can be implemented using primarily software, although portions may be implemented by well-known hardware components. The container monitoring system 10 continuously receives "INPUT" signals 40 from the transceiver 22 located inside the remote activator 12 to the transceiver 34 of the container monitoring system 10. At step 42 "OPERATION MODE", the CPU 6 evaluates these input signals. If a user wants to suspend operation of the container monitoring system 10, "OPERATION MODE" 42 of the monitoring system 10 prompts the "CODE REQUIREMENT" 44 to the user. The predetermined alarm code is compared to the previously stored code in the memory portion 32 of the monitoring system 10. If the user enters the code incorrectly a predetermined number of times, the CPU 6 will proceed to step 46, which energizes the alarm system 46 of the present invention. If the user enters the correct alarm code, the CPU 6 continues to the "DISARM" step 48 until the user wishes to use the security system and the system begins at "OPERATION MODE" 42 again. This will again require the user to enter the correct code before the container monitoring system is enabled.

If user does not opt to suspend operation of the container monitoring system 10, the CPU 6 checks whether the panic button 80 on the container 2 or panic button 18 on the remote activator 12 was pressed, at the "PANIC SENSOR/ALARM CODE" step 50. If button 18 or 80 was pressed, the alarm system 46 is triggered. If not, the CPU 6 then proceeds to the next step 52 to determine whether the "RANGE SIGNALS" between the container transceiver 34 and remote transceiver 22 are within the predetermined distance stored in either, or both, the remote activator memory means 24 and container memory means 32. If not, the CPU 6 will trigger the alarm system 46.

If the range requirement is met, the CPU 6 proceeds to step 54 to check "LOCK SENSOR" to determine whether the at least one electromechanical means 36*a* had been tampered with. If so the CPU 6 will trigger the alarm system 46. If not the procedure continues to "BAG SENSORS" 56 to determine whether there is a short circuit in the network present in the bag material 72, caused by the penetration of a foreign object through the container material 72. If so, the alarm system 26 is deployed by the CPU 6. Otherwise the CPU 6 starts the monitoring process again from the beginning "INPUT" step 40. It is obvious to one of ordinary skill that the specific monitoring sequence illustrated in FIG. 4 is not limited and may be arranged in series and/or parallel configuration.

Figure 5:
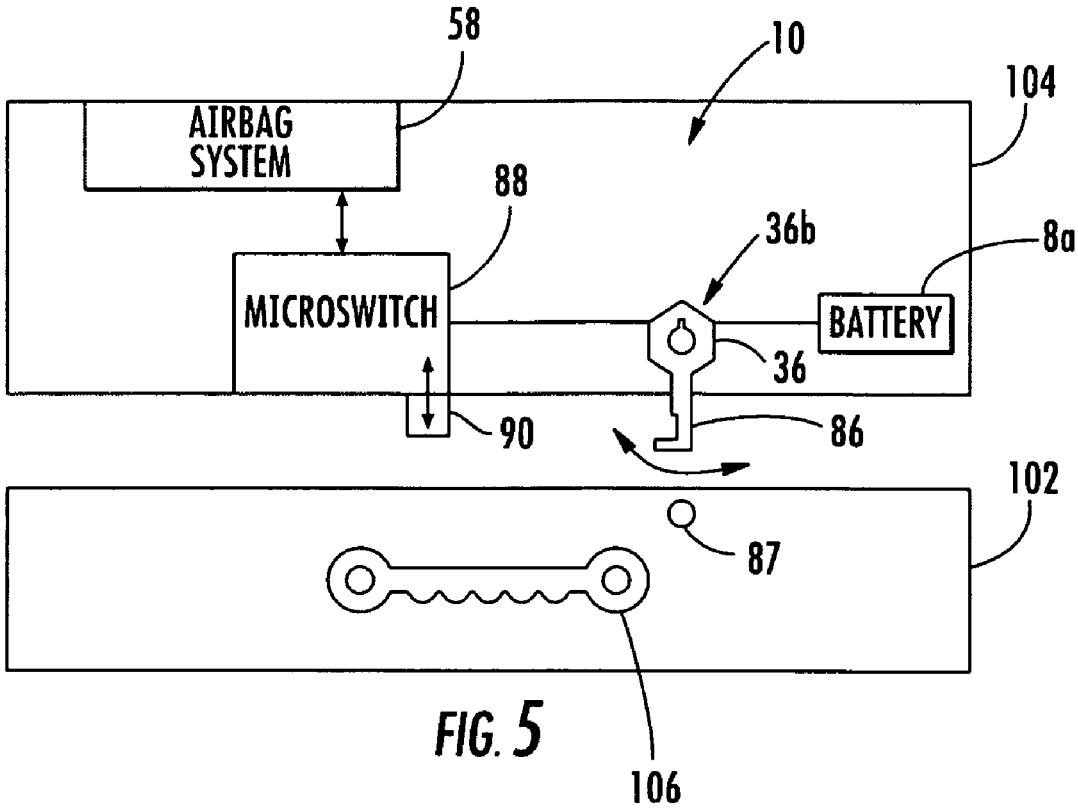
FIG. 5. illustrates a block diagram of the internal components of the portable remote activator system and a second embodiment of the container monitoring system.

FIG. 5 illustrates a simplified embodiment of the container monitoring system 10, wherein the electromechanical means 36*b* comprises a two-position cam switch lock 84 with at least one electrical contact known in the art and commercially available from a variety of sources, including Illinois Lock Company in Wheeling, Ill. Similar elements found in both FIGS. 3 and 5 are numbered consistently throughout. The cam switch lock 84 can be located anywhere across the container lid 104 and base 102 of the container 2 such that it can prevent access into the interior of the container 2. The cam switch lock 84 is in electrical communication with; a power source 8*a*, alarm system 46, and a micro-switch 88 (FIG. 5).

The cam switch lock 84 comprises a downward extending throw 86 rotatable from a locked position with a corresponding engagement means, for example post 87, to an unlocked position by operation of corresponding key (not shown). The cam switch lock 84 has electrical contacts that function as a "switch" to allow electricity to flow when the cam switch lock 84 is in the locked position and will function to prevent the flow of electricity there through when in the unlocked position. Similarly, the micro-switch 88 has a "closed biased" actuation means 90 that also functions as a "switch" such that when the lid 104 is opened the actuator 90 is not in contact with the base 102 and protrudes out of the micro-switch 88 housing and electricity is allowed to flow there through. Alternatively, if the lid 104 is closed the actuator 90 is pushed into the microswitch 88 by the base 102, and electricity cannot flow therethrough.

Figure 6:
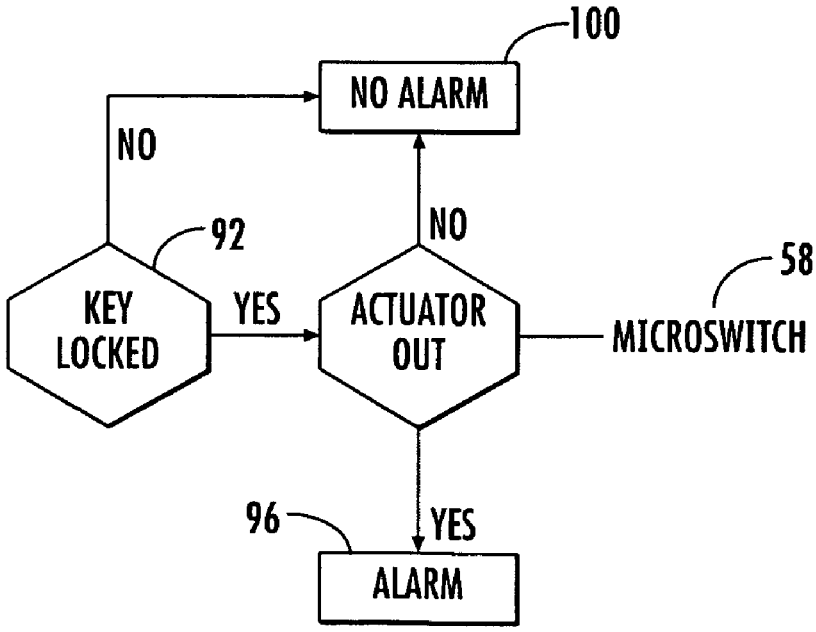
FIG. 6. illustrates a flow diagram of the internal components of a second embodiment of the container monitoring system seen in FIG. 5.

Operation of the container monitoring system 10*b* illustrated in FIG. 5 is best understood by making reference to FIG. 6. If at step 92 the cam switch lock 84 on the container 2 is in the "locked" position, electricity flows through it to the microswitch 88. If the micro-switch actuator 90 extends outward at step 94, the current flows through the microswitch 88. This indicates a theft event has occurred (i.e. container was pried open) and created a closed energy pathway from the energy source 8*a* to the alarm system component(s) 46 at step 96. Wherein the alarm system component(s), for example, the air bladder system 58 is deployed. However, if at step 94 the actuator 90 is in contact with the lid 104, current cannot flow to the micro-switch 88 and alarm system 46 are not triggered at step 100. Similarly, if at step 92 the cam switch lock 84 on the container 2 is not in the "locked" position, and alarm system components 46 are not deployed.

It should be noted that the cam switch lock 84 can be placed anywhere along the circuit between the power source 8*a* and the alarm system 46. Additionally, it would have been obvious to replace the cam switch lock 84 with a combination lock known in the art, such as the electronic combination switch lock 6100 series (not shown) commercially available from the Sargent & Greenleaf in Nicholasville, Ky. These electronic combination locks have a keypad for entry of a predetermined code. The electronic combination locks also have electrical contacts and which actuates a bolt mechanism between a "locked" and "unlocked" position when the correct combination is entered into the keypad.

Although not shown, the simplified electrometrical locking means 36*b* of FIG. 5 can also incorporate one or more of the various components shown in the embodiment of FIG. 3 for energizing the alarm system 46. For example, the monitoring system 10 of FIG. 5 could include a central processor unit 6 (CPU), memory means 32, and a transceiver 34 with GPS for communication with the remote activator means 12. Additionally, the monitoring system could include a panic button 80, a network of minute sensors, or a single sensor 30 on the container 2 all or partially in electrical communication with and the CPU 6.

Figure 7:
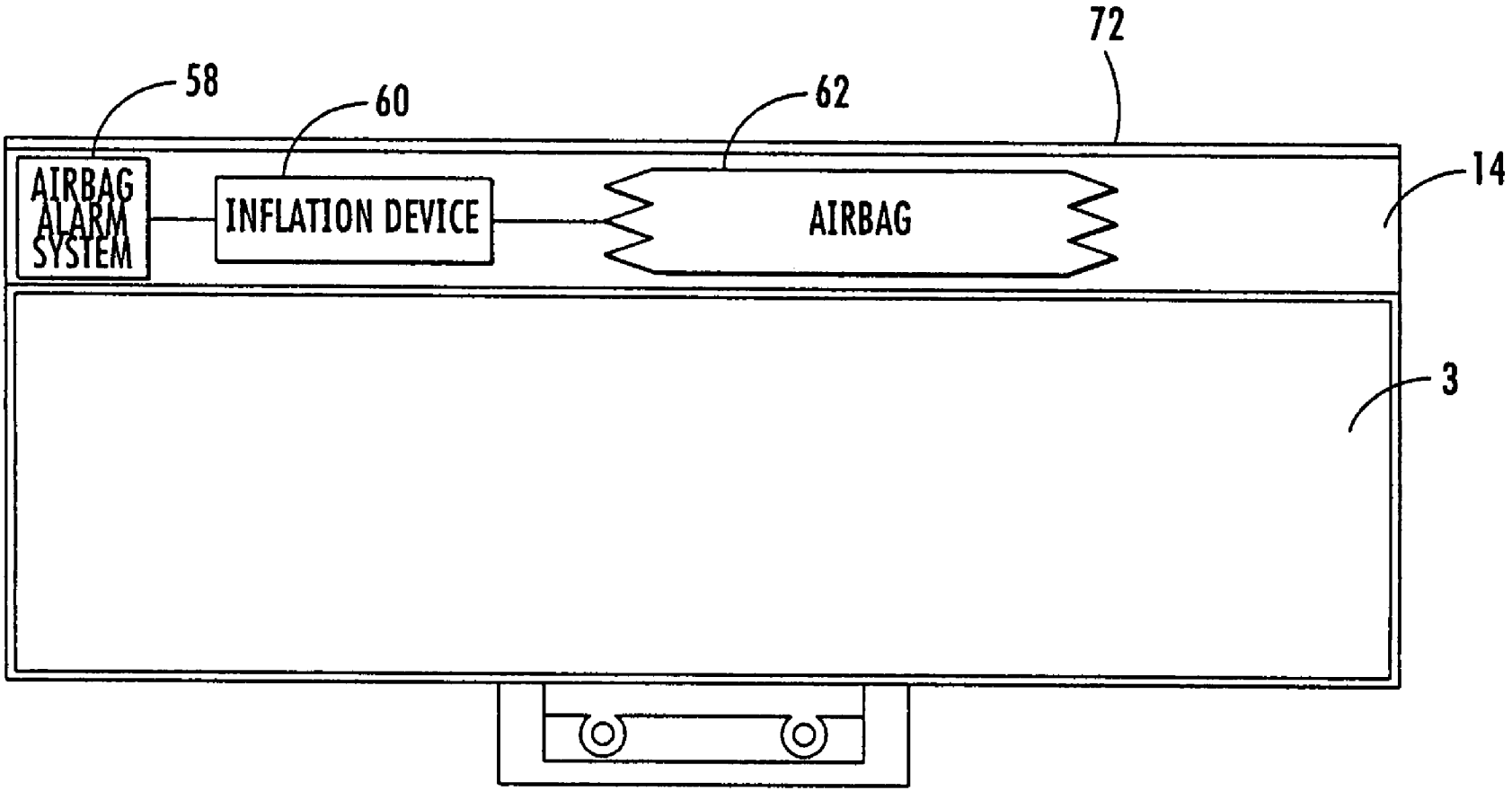
FIG. 7. illustrates an cross-section of the multi-purpose container in FIG. 1 such that the hidden second compartment containing the alarm system components of the present invention are visible in a deactivated state.

FIGS. 7 and 8 illustrate an exemplary air bladder component of the container alarm system 46 according to the invention that comprises an inflation device 60 for rapid inflation of an airbag 62 with a fluid. The inflatable air bladder, illustrated here as airbag 62 can be made from any type of flexible, durable material or a plurality of layers of material. Preferably, the material of the bladder is a self-sealing polymeric material, although not limited to, a non-foaming polyurethane, preferably poly(ether)-polyurethane like the self-sealing sheeting taught in U.S. Pat. No. 4,538,311 to Hall et al, the contents of which are herein incorporated by reference.

Not unlike an airbag inflation system in a car, the air bladder alarm system 58 of the present invention comprises an inflation device 60 that is activated such that the airbag 62 bursts from its stowed position inside the second compartment 14 (FIG. 7) through the container material 72 at an extremely high rate, e.g. a rate of approximately 200 mph. The inflation device 60 of the present invention can comprise a means to ignite (not shown) a solid propellant mixture of Sodium Azide, for example ($NaN_3$) and Potassium Nitrate ($KNO_3$), wherein the propellant burns extremely rapidly to create a large volume of fluid to inflate the air bladder 62.

Alternatively, the inflation device 60 may comprise a fluid storage tank (not shown) kept under high pressure and placed in fluid communication with the air bladder 62 via a fluid control means, such as solenoid valve (not shown), when the air bladder alarm system 58 is activated. The solenoid valve (not shown) can be used to control the pressure and flow of the fluid out of the fluid storage tank.

Unlike the airbag system of a car, the air bladder material of the instant invention does not allow the fluid to dissipate through tiny holes in the bag material after deployment. The air bladder 62 is deployed through the container material 72 and inflated to a size much larger than that of the container 2 (FIG. 8), such that it is not easily transported through a large doorway, or placed in the trunk of a car.

Moreover, after deployment the air bladder 62 should not be filled to a size that the air bladder material is taunt, which may allow for easy bursting when a sharp object is applied thereto. Rather, the air bladder 62 should be at such a pressure that it remains moderately limp when an external pressure is applied. However, the volume contained therein should not be such that the air bladder 62 can be compressed to get through standard doorways, etc. It is within the purview of this invention to store desired air bladder volume and pressure values in a container memory storage 32 and/or remote activator memory 24.

As shown in FIG. 4, the alarm system 46 can comprise other remotely activated components, as disclosed in Kuei et al U.S. Pat. No. 4,843,371, previously incorporated by reference. These other components can include a high voltage generator 74, an audio alarm 70, a smoking circuit 68, flasher 64 and/or other means of alerting known in the art.

The container 2 may comprise an attachment means, such as a holster 76, seen in FIG. 3, for attaching the remote activation means 12 such that the container monitoring system 10 do not detect out of range condition and does not deploy the alarm system 46. The holster 76 may be located anywhere inside the first compartment 3 or on the exterior of the container, or both locations. This allows for storage of the container 2 in a vault without deployment of the alarm system 46 of the instant invention.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and drawings/figures. One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention that are obvious to those skilled in the art are intended to be within the scope of the following claims.

What is claimed is:

1. A theft deterring multi-compartment container comprising:

a first compartment constructed and arranged to contain at least one article therein, said first compartment defined by a top wall, a bottom wall, and at least one side wall, wherein said top wall and bottom wall are in spaced apart relation; a second compartment constructed and arranged to contain an alarm system therein, said second compartment defined by at least one of said walls of said first compartment, at least one side wall, and an opposing wall in spaced apart relation from said at least one of wall of said first compartment;

an alarm system including at least one expandable air bladder which is placed in fluid communication with a compressed fluid source when said alarm system is energized;

a power source in electrical communication with said alarm system for selectively energizing said alarm system;

at least one electromechanical means having a throw switch positioned between said top wall and said bottom wall, and operable between an open position providing access into said first compartment and a closed position to prevent access into said first compartment, said electromechanical means providing electrical communication between said power source and said alarm system when said throw switch is in said closed position; and an actuator means in electrical communication with said power source, said alarm system, and said throw, wherein said actuator provides selective electrical communication between said power source and said alarm system to preclude energization of said alarm system when said actuator is in physical contact with at least one wall of said first container;

whereby said air bladder expands to an internal volume greater than said second compartment upon energization of said alarm system to a size sufficient to deter theft of said container when said throw is closed and said actuator is not in physical contact with at least one of said walls of said first container.

2. The theft deterring multi-compartment container of claim 1, further comprising a control means in electrical communication with said alarm means.

3. The theft deterring multi-compartment container of claim 2, further comprising at least one button positioned on said container in electrical communication with said control means for energizing said alarm means when said button is depressed.

4. The theft deterring multi-compartment container of claim 2, further comprising a conductive material and at least one material sensor formed on said material and in electrical communication with said control means.

5. The theft deterring multi-component container of claim 2, further comprising a first transceiver in electrical communication with said control means.

6. The theft deterring multi-component container of claim 5, further comprising a remote activation which includes an additional transceiver in remote communication with said transceiver.

7. The theft deterring multi-component container of claim 6, said remote activation further comprising a display means.

8. The theft deterring multi-component container of claim 6, wherein said transceiver further comprises a GPS receiver means for receiving radio signals from a GPS positioning system which are indicative of the latest spatial position of said GPS receiver to said remote activation means.

9. The theft deterring multi-component container of claim 6, further remote activation means further comprises a memory means containing a predetermined distance value, wherein said control means energizes said alarm system when said predetermined distance between said remote activation means and said container transceiver is greater than said predetermined distance value.

10. The theft deterring multi-component container of claim 6, wherein said remote activation means further comprises a button for energizing said alarm means when said button is depressed.

11. The theft deterring multi-component container of claim 6, wherein said remote activation means further comprises a keypad for entering a predetermined code for energizing said alarm means when said predetermined code is entered.

12. The theft deterring multi-component container of claim 6, wherein said remote activation means comprises least one member selected from the group of a cell phone, pager or key fob.

13. The theft deterring multi-component container of claim 1, wherein said at least one electromechanical means comprises an electrical combination lock.

14. The theft deterring multi-component container of claim 1, wherein said alarm system further comprises a fluid control means for release of said fluid.

15. The theft deterring multi-component container of claim 13, wherein said fluid is released under pressure.

16. The theft deterring multi-component container of claim 1, wherein said alarm system further comprises least one member selected from the group consisting of a flasher, smoke circuit and alarm sound, or high voltage generator.

17. The theft deterring multi-component container of claim 1, wherein said expandable air bladder comprises a puncture resistant and self-sealing material.

18. A theft deterring multi-compartment container comprising:

a first compartment constructed and arranged to contain at least one article therein, said first compartment defined by a first top wall, a bottom wall, and at least one side wall, wherein said first top wall and first bottom wall are in spaced apart relation;

a second compartment constructed and arranged to contain an alarm system therein, said second compartment defined by said at least one of said walls of said first compartment, at least one side wall, and an opposing wall in spaced apart relation from said at least one of walls of said first compartment;

at least one electromechanical means located between said first top wall and bottom wall constructed and arranged between an open position providing access into said first compartment and a closed position to prevent access to the first compartment;

a power source in electrical communication with said at least one electromechanical means;

at least one sensor in electrical communication with said power source and said alarm system;

a control means; and wherein said alarm system is energized such that said air bladder expands rapidly to an internal volume greater than said second compartment when said at least one electromechanical means is in a closed position and said at least one first sensor detects unauthorized access into said at least one electromechanical means.

19. The theft deterring multi-component container of claim 18, further comprising a button on said container in electrical communication with said control means for energizing said alarm means when said button is depressed.

20. The theft deterring multi-component container of claim 19, further comprising a remote activation means in remote communication with said transceiver.

21. The theft deterring multi-component container of claim 19, wherein said remote activation means further comprises a memory means containing a predetermined distance value, wherein said control means energizes said alarm system when the distance between said remote activation means and said transceiver is greater than said predetermined distance value.

22. The theft deterring multi-component container of claim 19, wherein said remote activation means comprises least one member selected from the group of a cell phone, pager or key fob.

23. The theft deterring multi-component container of claim 18, wherein said alarm system further comprises least one member selected from the group consisting of a flasher, smoke circuit, sound alarm, or high voltage generator.

24. The theft deterring multi-component container of claim 18, wherein said expandable air bladder comprises a puncture resistant, self-sealing material.

* * * * *